US011753204B2

(12) United States Patent
Sorbara et al.

(10) Patent No.: US 11,753,204 B2
(45) Date of Patent: Sep. 12, 2023

(54) POURABLE FOOD CONTAINER WITH DRINK SPOUT

(71) Applicant: TETRA LAVAL HOLDINGS & FINANCE S.A., Pully (CH)

(72) Inventors: Angelo Sorbara, Rubiera (IT); Daniele Palladino, Scandiano (IT); Maurizio Filippini, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/057,010

(22) PCT Filed: Jun. 4, 2019

(86) PCT No.: PCT/EP2019/064390
§ 371 (c)(1),
(2) Date: Nov. 19, 2020

(87) PCT Pub. No.: WO2020/007547
PCT Pub. Date: Jan. 9, 2020

(65) Prior Publication Data

US 2021/0188479 A1 Jun. 24, 2021

(30) Foreign Application Priority Data

Jul. 4, 2018 (EP) ..... 18181730
Nov. 30, 2018 (EP) ..... 18209612

(51) Int. Cl.
*B65D 5/74* (2006.01)
*B65D 5/56* (2006.01)
*B65D 47/08* (2006.01)

(52) U.S. Cl.
CPC ..... *B65D 5/746* (2013.01); *B65D 5/563* (2013.01); *B65D 47/0847* (2013.01)

(58) Field of Classification Search
CPC ..... B65D 5/746; B65D 5/563; B65D 47/103; B65D 47/0847; B65D 2401/15
(Continued)

(56) References Cited

U.S. PATENT DOCUMENTS 4,986,465 A * 1/1991 Jacobsson ..... B65D 5/727 220/269
5,065,938 A * 11/1991 Anderson ..... B65D 5/746 229/125.08

(Continued)

FOREIGN PATENT DOCUMENTS

CN 105705422 A 6/2016
EP 0751073 A1 1/1997

(Continued)

OTHER PUBLICATIONS

International Search Report (PCT/ISA/210) dated Jul. 17, 2019, by the European Patent Office as the International Searching Authority for International Application No. PCT/EP2019/064390.

(Continued)

*Primary Examiner* — Charles P. Cheyney
(74) *Attorney, Agent, or Firm* — BUCHANAN INGERSOLL & ROONEY PC

(57) ABSTRACT

A container for pourable food comprises an initially sealed body portion for holding the pourable food and a drink spout for drinking from the container. The proximal end of a base portion of the drink spout is permanently attached to the outer surface of the container, and has an opening to receive pourable food from the body of the container. The distal end of the base portion has an opening for drinking the pourable food from the container. The drink spout comprises a lid portion initially attached to the base portion to seal the opening at the distal end by a breakable sealing portion. The drink spout comprises a connection portion permanently attaching the lid portion to the base portion. The connection (Continued)

portion is a flexure hinge allowing the lid portion to pivot away from the base portion after the breakable sealing portion has been broken.

21 Claims, 9 Drawing Sheets

(58) Field of Classification Search
USPC ..... 222/541.9, 556, 541.5, 566; 220/258.2, 220/258.5, 375
See application file for complete search history.

(56) References Cited

U.S. PATENT DOCUMENTS 5,199,635 A * 4/1993 Abrams ..... B65D 5/746 229/125.09
5,271,519 A * 12/1993 Adams ..... B65D 47/36 220/375
5,484,101 A * 1/1996 Hedberg ..... B65D 5/708 220/255
5,799,840 A * 9/1998 Mogard ..... B65D 47/0842 222/541.5
6,402,019 B1 * 6/2002 Casale ..... B65D 5/749 229/123.2
6,454,161 B1 * 9/2002 Rendina ..... B65D 5/746 220/255.1
6,554,181 B1 * 4/2003 Dammers ..... B65D 5/748 229/125.04
6,626,315 B2 * 9/2003 Lees ..... B29C 45/14336 220/259.1
9,309,041 B2 * 4/2016 Mabee ..... B65D 47/0814
2002/0030092 A1 3/2002 Rendina et al.
2006/0144876 A1 * 7/2006 Wassum ..... B65D 5/746 222/529
2013/0146559 A1 6/2013 Nilsson
2016/0235227 A1 8/2016 Cable et al.
2017/0107023 A1 4/2017 Miksovsky et al.

FOREIGN PATENT DOCUMENTS

EP 1279609 A1 1/2003
JP 2002-128125 A 5/2002
JP 2004-067185 A 3/2004
JP 2016-210472 A 12/2016
WO 9108957 A1 6/1991
WO 0016668 A1 3/2000
WO 2007021231 A1 2/2007

OTHER PUBLICATIONS

Written Opinion (PCT/ISA/237) dated Jul. 17, 2019, by the European Patent Office as the International Searching Authority for International Application No. PCT/EP2019/064390.
Office Action (The First Office Action) dated May 24, 2022, by the State Intellectual Property Office of People's Republic of China in corresponding Chinese Patent Application No. 201980045066.3. (6 pages).

* cited by examiner

POURABLE FOOD CONTAINER WITH DRINK SPOUT

TECHNICAL FIELD OF THE INVENTION

The present invention relates to containers for pourable food. More specifically, the present invention relates to containers for pourable food comprising a drink spout as well as a drink spout for a container for pourable food

BACKGROUND OF THE INVENTION

Containers for pourable food are widely used by consumers around the world. There is consensus that such containers are useful for transporting pourable food, and in particular beverages, to locations remote from the food production sites throughout the globe while at the same time preserving the quality of the packaged food, preventing contamination, and protecting against premature spoilage.

At the same time, it must be recognized that when such containers are used only a single time, an undesirably large amount of used and empty containers is disposed of. To address this concern, recycling systems for used containers have been successfully employed. For these systems to be efficient, it is desirable that as many parts of such containers as possible are collected in the receptacles for the used containers.

Accessory items such as straws and their wrappers, both which are typically affixed to the outside of the food containers, may become detached from the container and subsequently be disposed of separately from the container and potentially outside the designated recycling systems.

Document EP 1 279 609 A1 describes a reclosable opening device for a pourable food product package. The opening device comprises a neck defining a pouring opening.

Document WO 2000/016668 A1 discloses a retractable drink spout for use with a drink container. The spout includes a straw structure having two ends and a passageway extending between the two ends through which liquid may pass, and a support joined to the straw structure to support the straw structure, where the support is configured to move between retracted and extended positions, and where moving the support retracts and extends the straw structure.

Document EP 0 751 073 A1 discloses a closure for a container of liquid, granular or powdery products. The closure comprises: a hub defined by a tubular central body (5*a*), an upper free edge and a base fixed outside the cited container and peripherally external to the pouring opening of this latter; a cap removably matchable to the hub in correspondence to a closed condition of the closure; a sheet element peripherally welded to the upper edge of the hub and removable in correspondence to a condition of first fruition of the product packaged inside the container; hooking means fit to join the cap to the hub in correspondence to the closed condition.

It is the objective of the container and the drink spout suitable for use with a container of the present invention to overcome the issues and challenges faced by the prior art.

It is one aspect of the present invention to provide a container for pourable food from which a consumer can drink comfortably without having to detach a wrapped straw, unpack the straw from the wrapper, pierce a straw through the body of the package, and dispose of the empty wrapper.

It is another aspect of the present invention to provide a container for pourable food from which a consumer can drink conveniently without risking spilling the pourable food due to an imperfect seal between the lips and the container.

It is another aspect of the present invention to provide a container for pourable food for which all components will routinely remain attached to one another so that they can be disposed of together after use. This aspect is particularly useful for portion-sized containers which are intended to be emptied and then discarded within a short period of time and on-the-go.

It is another aspect of the present invention to provide a drink spout for pourable food containers which has a better hygiene for drinking directly from the container.

SUMMARY OF THE INVENTION

In a first aspect, the present invention provides a container for pourable food as described in claim 1.

The container comprises an initially sealed body portion for holding the pourable food and a drink spout adapted for drinking from the container. The drink spout is permanently attached to the container. The drink spout comprises a base portion wherein the proximal end of the base portion is permanently attached to the container, the proximal end has an opening adapted for receiving pourable food from the body of the container, the distal end of the base portion has an opening adapted for drinking the pourable food from the container, and the opening at the proximal end and the opening at the distal end are connected by a conduit for pourable food. The drink spout comprises a lid portion which is initially attached to the base portion so that it seals the opening at the distal end by a breakable sealing portion wherein the sealing portion is adapted for being broken by the user so that the opening of the base portion becomes accessible. The drink spout comprises a connection portion permanently attaching the lid portion to the base portion whereby the connection portion is a flexure hinge providing a first angular degree of freedom allowing the lid portion to pivot away from the base portion after the breakable sealing portion has been broken.

In a second aspect, the present invention provides a drink spout suitable for use with a container for pourable food according to the present invention.

BRIEF DESCRIPTION OF THE FIGURES

These and other aspects, features and advantages of which examples of the invention are capable of will be apparent and elucidated from the following description of examples of the present invention, reference being made to the accompanying drawings, in which.

In the figures, the features of the depicted exemplary embodiments are designated with the following reference numerals. Similar features in different exemplary embodiments may be numbered with the same reference numerals.

Figure 1:
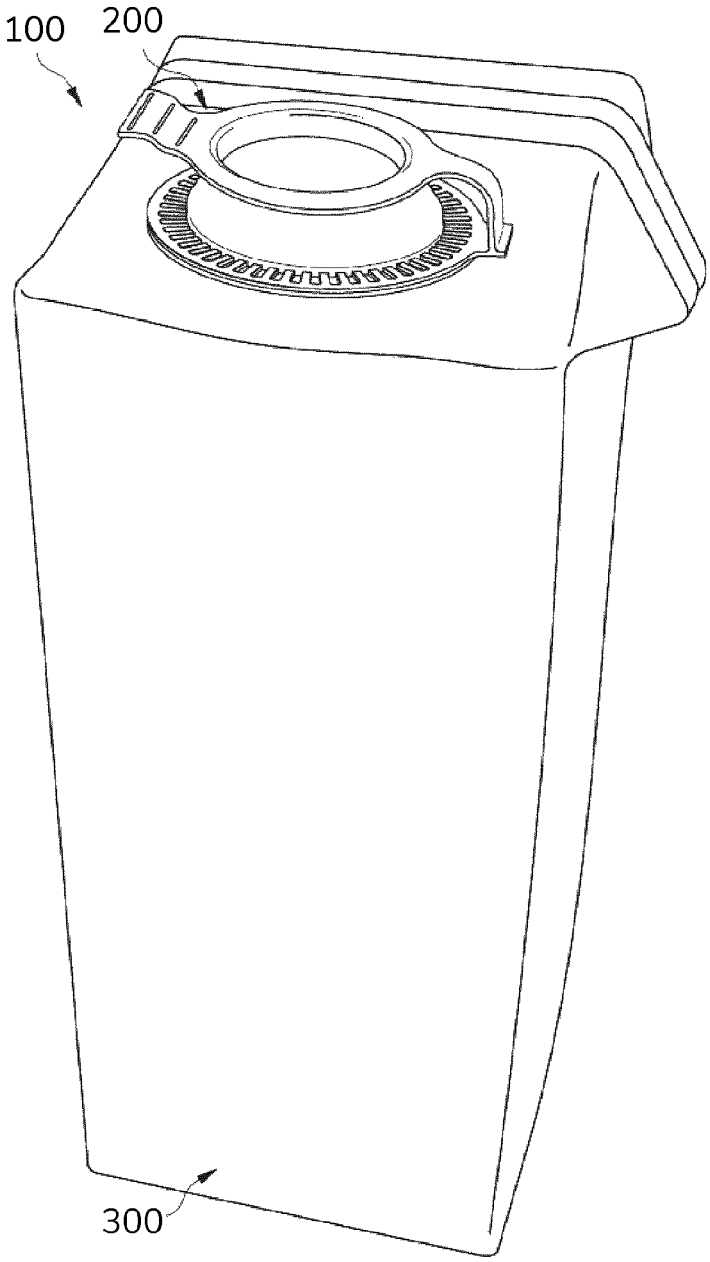
FIG. 1 shows a perspective view of an exemplary embodiment of the container for pourable food according to the present invention.

100 Container for pourable food
200 Drink spout
210 Base portion
220 Proximal end
225 Proximal end portion
230 Distal end
235 Distal end portion
240 Flange of base portion
250 Lid portion
260 Flange of lid portion
270 Connecting portion
280 Holder
290 Anchor portion
300 Body portion
310 Inner surface of the body portion

DETAILED DESCRIPTION OF THE INVENTION

Specific examples of the invention will now be described with reference to the accompanying drawings. This invention may, however, be embodied in many different forms and should not be construed as limited to the examples set forth herein; rather, these examples are provided so that this disclosure will be thorough and complete, and will fully convey the scope of the invention to those skilled in the art. The terminology used in the detailed description of the examples illustrated in the accompanying drawings is not intended to be limiting of the invention.

The present invention relates to a container for pourable food.

As used herein, the term "container for pourable food" refers to any object for holding or transporting pourable food.

As used herein, the term "pourable food" refers to any product for human or animal consumption which can be poured from a container through an opening of appropriate size. The pourable food can be liquid, fluid, granular, or the like. The pourable food may comprise solid pieces of food which can be poured together with the liquid or fluid portion of the pourable food.

The container comprises an initially sealed body portion for holding the pourable food prior to consumption by the consumer. The sealing of the body portion is intended to prevent leakage of the pourable food and to protect the pourable food from contamination.

The body portion of the container may comprise a flat top surface adapted for holding the drink spout. A flat top portion may provide planar surface to which the drink spout can be attached conveniently. In case of a planar top surface and a planar proximal end of the pour spout, no axial rotation of the drink spout about an axis perpendicular to the plane of the proximal end is required for finding the proper orientation for attachment. The planar top surface may be aligned with the horizontal plane when the container is in its upright position. The planar top surface may be aligned with the horizontal plane when the container is in its upright position. The planar top surface may be slanted with respect to the horizontal plane when the container is in its upright position.

The container comprises a drink spout adapted for drinking from the container, preferably drinking directly from the container without using additional accessories for guiding the pourable food such as drinking straws.

The drink spout comprises a base portion and a lid portion. The base portion is facing towards the outer surface of the body portion of the container. Preferably, at least 50 weight-% of the base portion, more preferably at least 75 weight-%, are placed outside of the outer surface of the container body portion. Any portion of the drink spout that is placed inside the outer surface of the body portion will only reduce the internal volume of the container without offering a functional benefit for drinking. Only those portions of the drink spout which are functionally contributing to the attachment of the drink spout to the container body may be advantageously positioned inside the pouter surface. The lid portion is facing away from the container and towards the consumer.

The proximal end of the drink spout is permanently attached to the container. The term "permanently attached" as used herein means that the drink spout is not intended to be separated from the body of the container during normal use. The drink spout may be formed as an integral part of the container. The drink spout may be intended to be disposed of together with the container. A permanent attachment can be achieved through a variety of technical means such as adhesive, heat, or ultrasonic bonding. The permanent attachment may be achieved by moulding the drink spout directly onto the material. The permanent attachment may be achieved by moulding the drink spout directly through the material so that after moulding a portion of the drink spout is positioned on the inside surface of the body portion and another portion of the drink spout is positioned on the outer surface of the body portion. A suitable moulding technique is injection moulding and more specifically micro-injection moulding. The proximal end of the drink spout may be permanently attached to the inner surface of the container. The proximal end of the drink spout may be permanently attached to the outer surface of the container. The proximal end of the drink spout may be permanently attached to both the inner and the outer surface of the container.

The permanent attachment of the drink spout to the container may be configured such that at least 50 weight-%, preferably at least 75 weight-%, more preferably at least 90 weight-%, yet more preferably at least 95 weight-%, of the drink spout may separated from the container after the intended use such as after disposal or during recycling of the container. The removal may be effected by chemical, thermal, or mechanical separation.

During use, the pourable food is intended to flow from the body portion and through the drink spout into the mouth of the consumer. The proximal end of the drink spout has an opening adapted for receiving pourable food from the body of the container. Before use, the seal of the body portion may have to be broken or pierced by the consumer. The body portion may comprise one or more areas which are adapted for convenient opening by the consumer such as a pre-laminated hole and a thinner portion of the container wall. The opening and the inner surface of the drink spout may be designed to allow easy pouring and not provide any flow hindrance to the poured food. The opening of the proximal end may be aligned with those areas of the body portion that are adapted for convenient opening by the consumer.

The distal end of the base portion of the drink spout has an opening adapted for drinking the pourable food from the container. The aim of such adaptation is that drinking the liquid food from the container through the drink spout becomes convenient for the intended consumer. The specific design of the container may be chosen in dependence of the type of food (viscosity, particulate content, etc.) as well as in dependence of the anticipated consumers (adults, children, elderly, etc.) as well as the anticipated usage situation (sitting at a table, riding a bike, running, etc.). The term "drinking" as used herein refers to take (a liquid) into the mouth and swallowing. The term "drinking" is to be distinguished from the term. "pouring" which, as used herein, refers to cause (a liquid) to flow from a container in a steady stream. A drink spout may be suitable for pouring the pourable liquid, but not every pour spout is suitable for drinking.

Drinking the pourable food from the container requires that the connection formed between the distal end portion of the drink spout and the mouth of the consumer is such that little or preferably no leakage can occur during the drinking process. For example, leakage can be avoided if the lips of the consumer can be comfortably wrapped around the distal end portion to form an essentially liquid tight connection. The geometric configuration of the drink spout plays an important role and should be designed to conform with the natural configuration of the consumer's lips in a drinking position. The height of the drinking spout which is the distance between its proximal and its distal end is also important to provide enough surface area for the lips top seal the connection with the base portion of the drink spout.

The drink spout is permanently attached to the container body. The permanent attachment provides that the drink spout cannot be separated easily from the container and hence will likely be disposed of together with the container. The drink spout may be attached to the inner surface of the container body. The attachment to the inner surface may be realized through attaching an anchor portion to the inner surface of the container body whereby the anchor portion is connected to the base portion of the drink spout. The drink spout may be alternatively attached to the outer surface of the container body. The attachment to the outer surface may be realized through attaching a flange portion to the outer surface of the container body whereby the flange portion is connected to the proximal end of the base portion of the drink spout. The drink spout may alternatively be attached to both the outer and the inner surface of the container body.

The opening at the proximal end and the opening at the distal end of the base portion are connected by a conduit for pourable food. The conduit provides that the pourable food can flow from the body portion of container through the drink spout into the mouth of the consumer. The inner surfaces of the base portion of the drink spout form the conduit. The cross-section of the conduit may remain essentially the same along the length of the conduit or may vary in order to improve the drinking properties for the user. The shape and the size of the cross section may be adapted to the type and properties of the pourable food.

The base portion of the drink spout may have a rigid configuration. The term "rigid configuration" as used herein refers to a configuration that remains essentially unchanged during the use of the container. The use is the time interval starting with the breaking of the breakable sealing portion until the consumer starts drinking from the base portion or preferably until the consumer has finished consuming the pourable food from the container. More specifically, the relative positioning of the various elements of the base portion, such as proximal end and distal end, relative to each other or relative to the outer surface of the container, or relative to the area of attachment of the drink spout to the outer surface of the container may remain essentially unchanged. The drink spout may have only one component, the lid portion, that is movable with respect to the base portion.

Any part of the conduit including the proximal end and the distal end may comprise a cross-sectional membrane having a reclosable opening that opens under pressure. With that membrane, the tendency of the pourable food to leak from the container under the influence of gravity is reduced or even eliminated depending on the viscosity of the pourable food. The user may pressurize the pourable food in the container such as by squeezing the container. The pressurized food in turn may cause the reclosable opening in the membrane to open so that a, preferably controllable, amount of the pourable food can be discharged from the bottle through the drink spout.

The drink spout comprises a lid portion which is initially attached, preferably directly attached, to the base portion so that it seals the opening at the distal end by a breakable sealing portion wherein the sealing portion is adapted for being broken by the user so that the opening of the base portion becomes accessible. The term "directly attached" as used herein means that the lid portion is movable in any degree of freedom without also moving the base portion in a similar manner. While being directly attached, the lid portion and the base portion can only be moved together.

The breakable sealing portion is designed such that the consumer can conveniently break the sealing portion, such as by pulling the lid portion away from the base portion, without damaging either the lid portion or the base portion and without detaching the lid portion from the base portion. The breakable sealing portion may be breakable by pulling the lid portion away from base portion. The breakable sealing portion may be breakable by tearing at least a portion of the sealing portion. The sealing portion may be torn completely. The lid portion may consequently no longer be directly attached to base portion.

The lid portion may seal the opening in a liquid tight manner so that the container cannot leak prior to use. In this case, the initial sealing of the body portion comprises the seal formed between lid and base portion. The seal of the lid portion to the base portion may also be formed that the lid portion serves as a hygienic cover over the distal end, preferably the distal end portion, of the base portion without having to be fully liquid tight. The base portion may be arranged such that the drink spout is immediately available for drinking after breaking the breakable sealing portion and moving the lid portion away. The lid portion and the base portion are arranged such that the pour spout can be opened in one step by breaking the breakable sealing portion.

The lid portion remains permanently attached to the container by a connection portion after the breakable sealing portion has been broken by the user. The lid portion attaches the lid portion to the base portion. The connection portion may be joined to the lid portion and the edge of the lid or to a flange portion of the lid portion. The connection portion may be joined to the proximal end portion of the base portion or a flange portion associated with the proximal end portion of the base portion.

The connection portion is flexible to allow the lid portion to be moved away from the opening in the distal end. When the lid portion is moved away, the consumer has easy access to the opening before drinking. The connection portion has at least one compliant degree of freedom to allow the lid portion to be moved away from the opening. The degree of freedom may be aligned with the longer axis of the opening so that lid portion can be swiveled away from the opening easily. The connection portion may take the form of a flexure hinge. The term "flexure hinge" as used herein refers to any flexible element (or combination of elements) engineered to be substantially compliant in specific degrees of freedom. The longitudinal dimension of the connection element is defined as the distance between the connection points with the lid portion and the base portion and is measure along the connection element, preferably along the centre line of the connection element. When the connection portion is bent, the longitudinal dimension follows the curved geometry of the connection portion and is not linear. The transverse dimension of the connection portion is defined as the dimension that is parallel to the plane defined by the proximal end of base portion. At each point, the thickness dimension of the connection portion is defined as the dimension that is perpendicular to the longitudinal and the transverse dimension. The connection elements may constrain the degrees of freedom of the lid portion in relation to the base portion such that the distance of the lid portion from the base portion in the longitudinal dimension remains essentially unchanged.

A suitable flexure hinge for connecting the lid portion to the base portion may take the form of a pin flexure (a thin bar or cylinder of material between the connection points). The cross section of the bar or cylinder may vary along the longitudinal dimension of the connection portion or it may remain substantially unchanged for at least 25%, preferably 50%, yet more preferably 75%, of the longitudinal dimension. A suitable pin flexure can have circular, an elliptic, a, triangular, a quadrangular, a rectangular, a polygonal, or similar cross-section (at each point taken perpendicular to the longitudinal dimension) along its central portion which is the middle portion along the longitudinal dimension. The central portion has a longitudinal dimension which is at least 25%, preferably 50%, yet more preferably 75%, of the longitudinal dimension of the connection portion. The longer dimension of the elliptical or rectangular cross-section may be oriented in the transverse dimension. The connection portion may have a longitudinal dimension that is at least three times longer than either its transverse dimension or its thickness.

The flexure hinge may alternatively take the form of a blade flexure (a thin sheet of material between the connection points). The flexure hinge may alternatively take the form of a notch flexure (a thin cut-out on both sides of a thick piece of material).

The flexibility of the connection provides a first angular degree of freedom allowing the lid portion to pivot away from the base portion after the breakable sealing portion has been broken. "To pivot" as used herein refers to a rotational movement around a given pivot point. The rotational movement may be two-dimensional (moving on the surface of a sphere when the distance to the pivot point is fixed, the position thus being defined by a first and a second angular degree of freedom) or one-dimensional (moving along a circular curve when the distance to the pivot point is fixed, the position thus being defined by a first angular degree of freedom). The pivot point around which the lid portion pivots may be the point at which the connection portion is attached to the base portion. The distance of the lid portion, more precisely the centre of gravity of the lid portion, from the pivot point may be constant or variable during the pivoting movement.

The pivoting movement may be a rotation around an axis that is transverse with respect to the connection portion and parallel to the plane defined by the proximal end of the base portion. Such an axis may be a tangent to the base portion at the point where the connection portion is attached to the base portion. This distance of the lid portion from the axis during the rotational movement may remain constant or vary.

FIG. 1 shows a perspective view of an exemplary embodiment of the container for pourable food 100 according to the present invention. The container comprises an initially sealed body portion 300 for holding the pourable food and a drink spout 200 adapted for drinking from the container.

Figure 2:
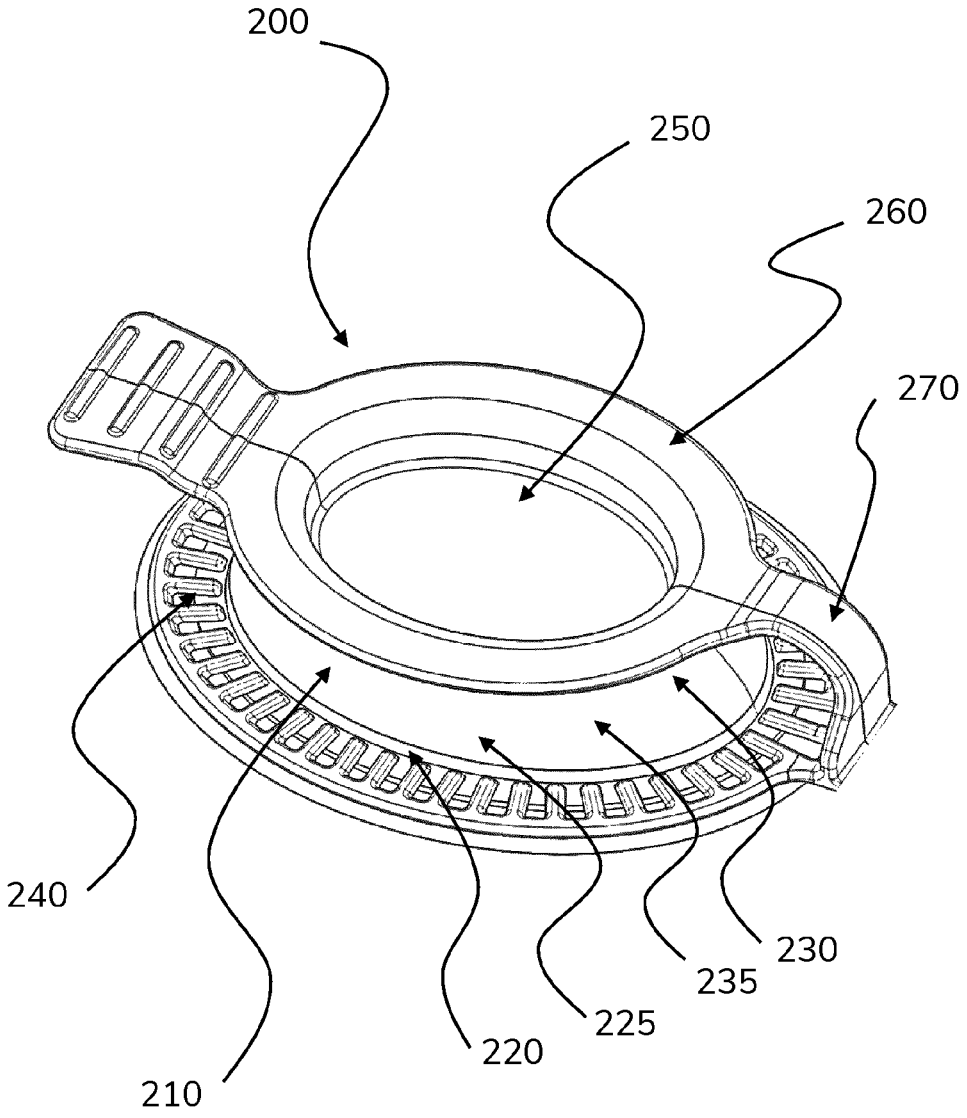
FIG. 2 shows an enlarged perspective view of an exemplary embodiment of a drink spout suitable for use with the container for pourable food according to the present invention.

FIG. 2 shows a more detailed view of an exemplary embodiment of the drink spout 200 of the present invention. The drink spout 200 is permanently attached to the outer surface of the container. The drink spout comprises a base portion 210 wherein the proximal end portion 225 with its proximal end 220 of the base portion is permanently attached to the outer surface of the container. The base portion of the drink spout may comprise a flange 240 connected to the proximal end for improving the attachment to and the seal with the outer surface of the container. The proximal end 220 has an opening adapted for receiving pourable food from the body of the container, the distal end portion 235 with its distal end 230 of the base portion has an opening adapted for drinking the pourable food from the container, and the opening at the proximal end and the opening at the distal end are connected by a conduit for pourable food. The drink spout comprises a lid portion 250 which is initially attached to the base portion so that it seals the opening at the distal end by a breakable sealing portion wherein the sealing portion is adapted for being broken by the user so that the opening of the base portion becomes accessible and which remains permanently attached to the container by a connection portion 270 after the breakable sealing portion has been broken by the user.

The lid portion may be pivotable between a first position for protecting the base portion and a second position for drinking. In the first position, the function of the lid portion is to protect and potentially seal the distal end of the base portion when the user is not drinking from the container. The lid portion may be in sealing contact with the distal end of the base portion when in the first position. The base portion may be designed such that the lid portion must be slightly and reversibly deformed when being pushed into the first position. In this case, the lid portion may be held in the first position by friction and restoration forces. When moved into the second position, the distal end of the base portion is available for drinking from it. The lid portion may be moved from the first into the second position and back through the pivoting along the first degree of freedom. The minimal distance between the base portion and the lid portion should be chosen to allow convenient drinking from the drink spout. The minimum distance may preferably be at least 5 mm, yet more preferably at least 8 mm.

Figure 3:
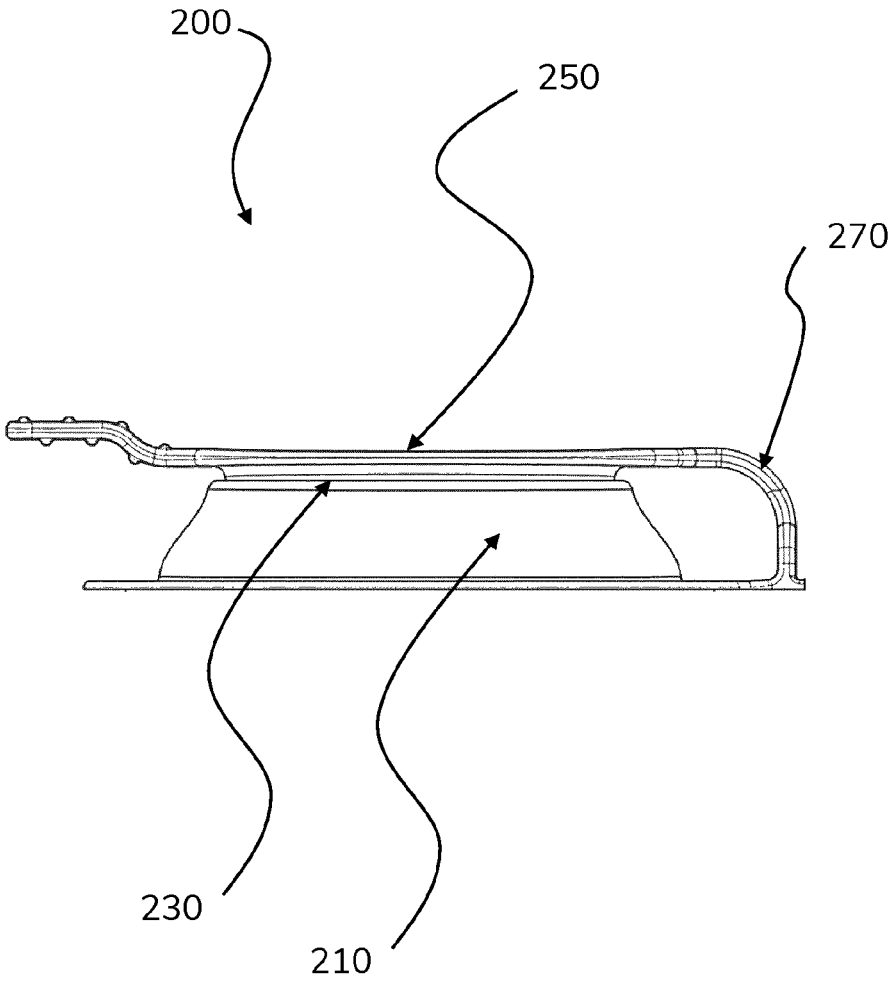
FIG. 3 shows a side view of the exemplary drink spout of FIG. 2.

FIG. 3 shows a side view of the exemplary drink spout 200 of FIG. 2 when the lid portion 250 is in the first position protecting the distal end 230 of the base portion 210. The connection portion 270 connects lid portion 250 to the base portion 210.

The drink spout may further comprise a holder for holding the lid portion in the drinking position while the holder is engaged with the lid portion or the connection portion. The lid portion may not stay in the second position while the user is drinking from the drink spout. The lid portion may move due to gravitational forces, due to restoration forces stemming from the connection portion or due to inertial forces as a result of a movement of the user while drinking. It may thus be beneficial to provide a holder for holding the lid portion in the second position while the user is drinking. The holder is designed such that it prevents the lid from moving back towards the first position and preferably to stay in or close to the second position so that continued and convenient drinking from the container remains possible. For this purpose, the holder may exert a holding force onto the connection portion or the lid portion. The holder may be in contact with the connection portion or the lid portion for exerting the holding force. The surface contact between the holder and the connection portion or the lid portion in combination with a restoration force pushing the connection portion or the lid portion towards the holder may create a friction force that keeps the connection portion or the lid portion in the second portion.

The holder may be positioned with its base in the plane defined by proximal end of the base portion. The holder may be positioned close to the point at which the connection portion is joined to the base portion. The holder may be positioned radially outward from this point with respect to a centre axis of the base portion, so that the holder is configured to hold the lid portion away from the base portion when the holder is engaged with the lid portion or the connection portion. The radial distance between the joinder of the connection portion with the base portion and the base of the holder may be between 10% and 50% of the longitudinal dimension of the connection portion, preferably between 20% and 40%.

Figure 4:
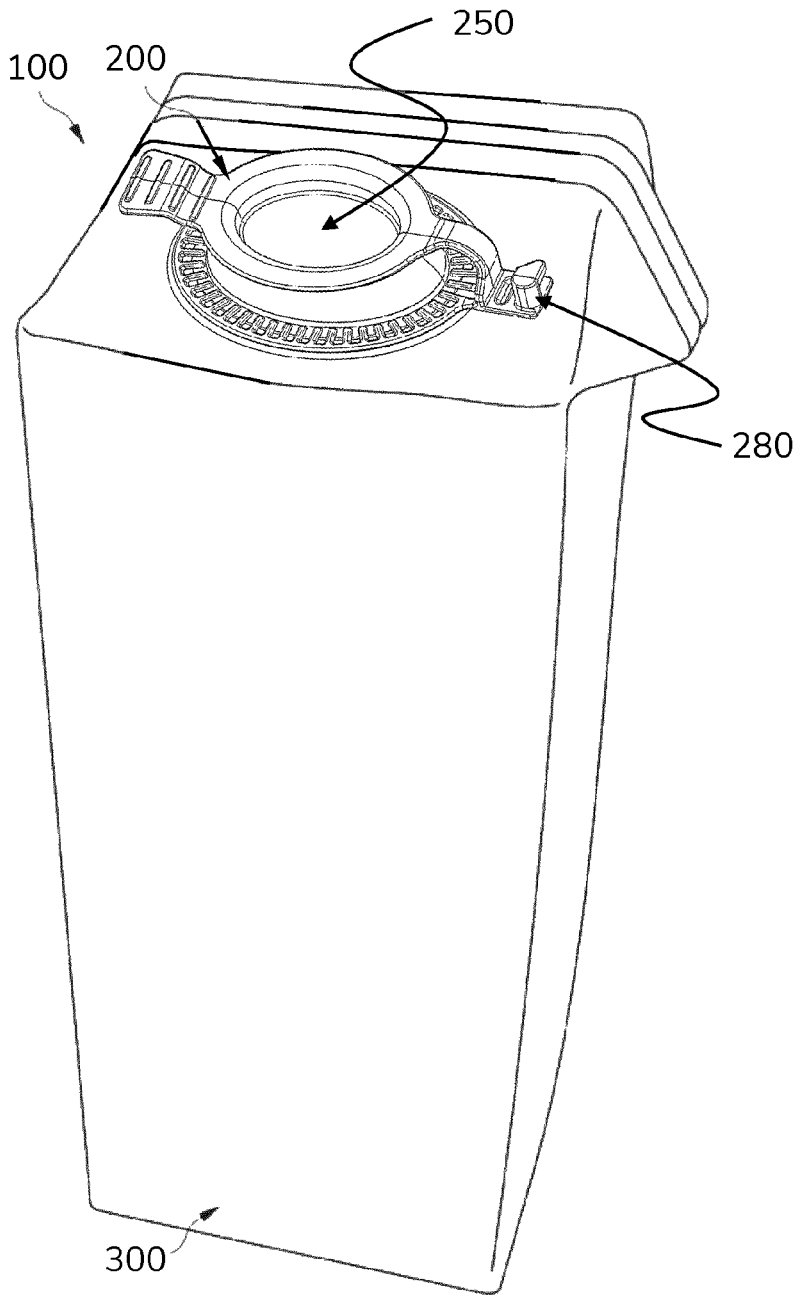
FIG. 4 shows a perspective view of an exemplary embodiment of the container for pourable food according to the present invention.

FIG. 4 shows a perspective view of an exemplary embodiment of the container for pourable food 100 according to the present invention. The container 100 is similar to the container shown in FIG. 1, but the drink spout now further comprises a holder 280 for holding the lid portion in the drinking position while the holder is engaged with the lid portion or the connection portion. In this example, the holder 280 has the form of a hook.

Figure 5:
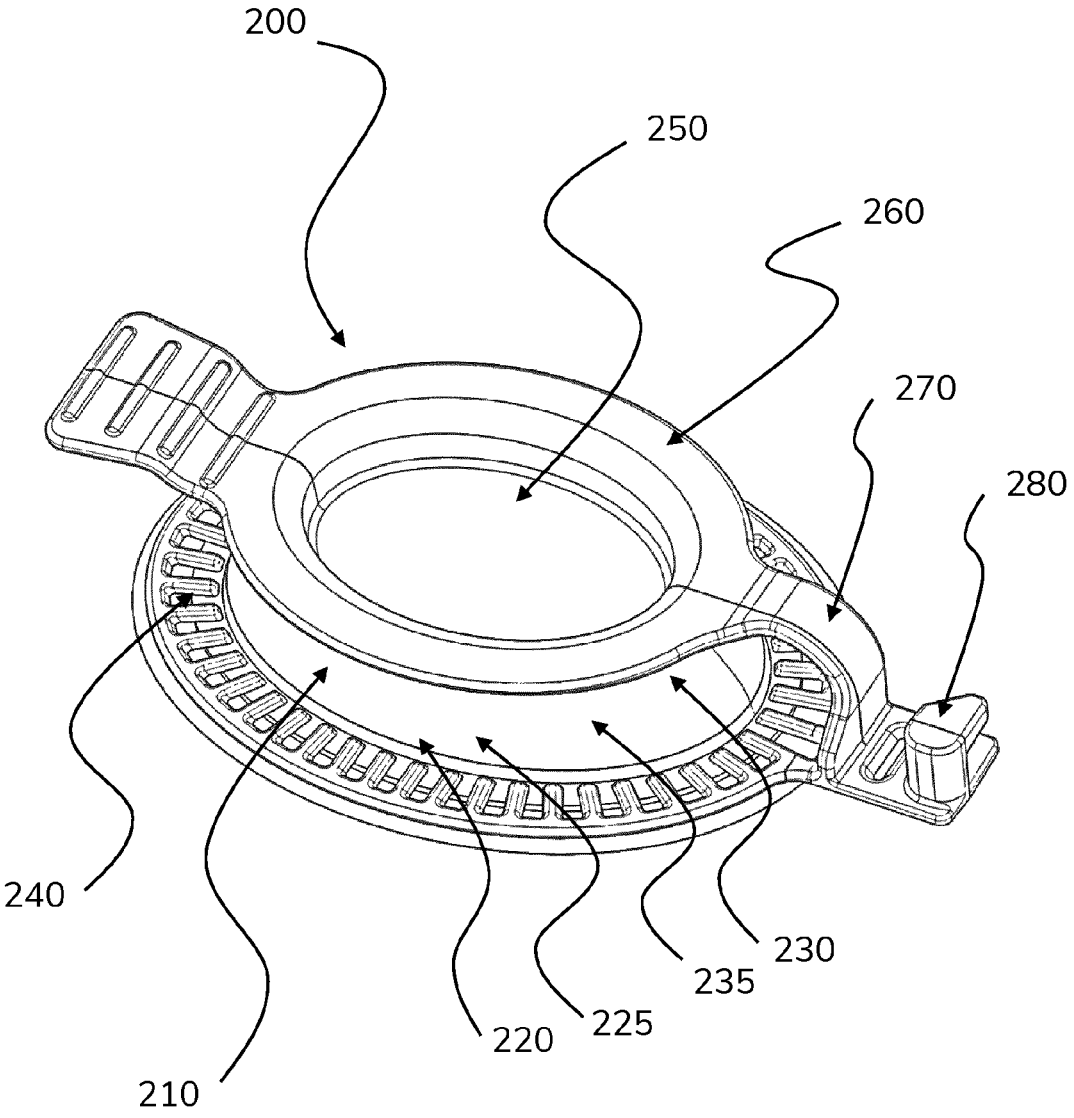
FIG. 5 shows a more detailed view of an exemplary embodiment of the drink spout of the present invention shown in FIG. 4.

FIG. 5 shows a more detailed view of an exemplary embodiment of the drink spout 200 of the present invention shown in FIG. 4. The drink spout 200 is similar to the drink spout shown in FIG. 2, but now further comprises a holder 280 for holding the lid portion in the drinking position while the holder is engaged with the lid portion or the connection portion. In this example, the holder 280 has the form of a hook.

Figure 6:
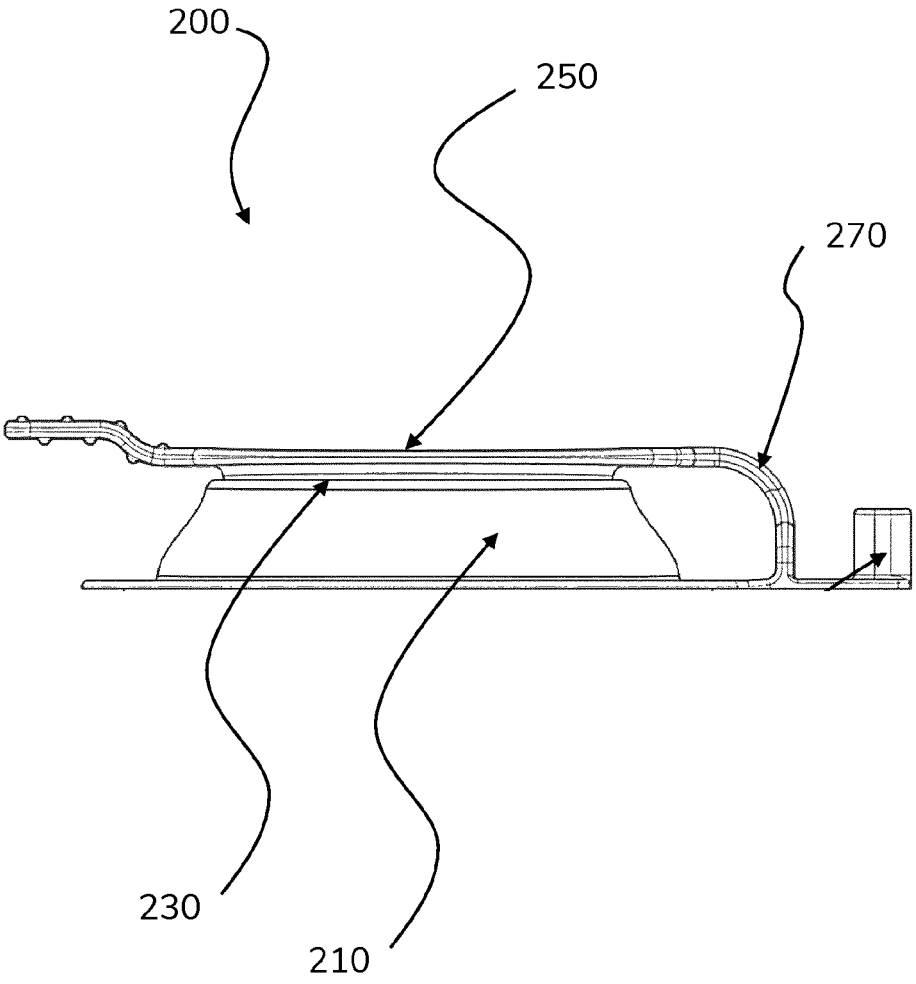
FIG. 6 shows a side view of the exemplary drink spout of the present invention shown in FIG. 5.

FIG. 6 shows a side view of the exemplary drink spout 200 of FIG. 5 when the lid portion 250 is in the first position protecting the distal end 230 of the base portion 210. The connection portion 270 connects lid portion 250 to the base portion 210. The holder 280 is positioned on the outer side of the connection portion where the connection portion is attached to the base portion 210.

Figure 7:
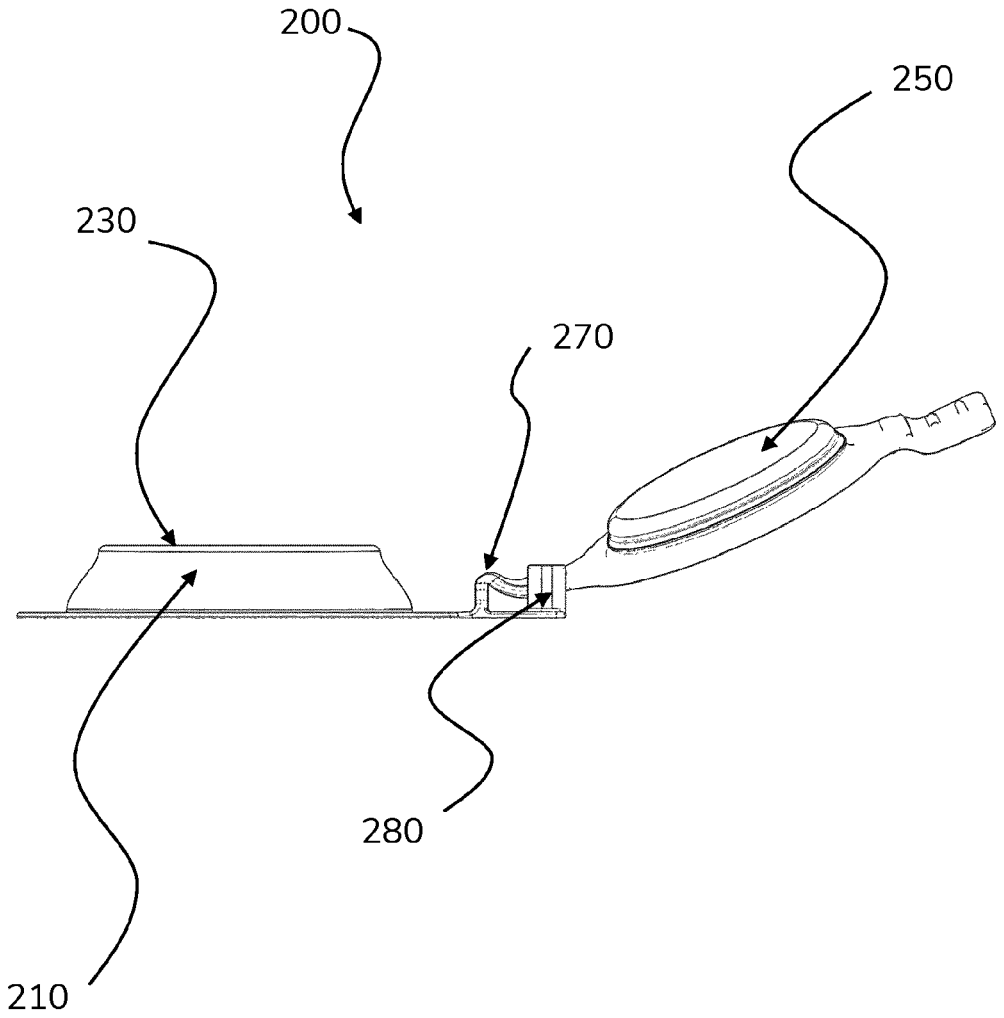
FIG. 7 shows a further side view and FIG. 8 shows a further perspective view of the exemplary drink spout of FIGS. 5 and 6 when the lid portion is in the drinking position.
Figure 8:
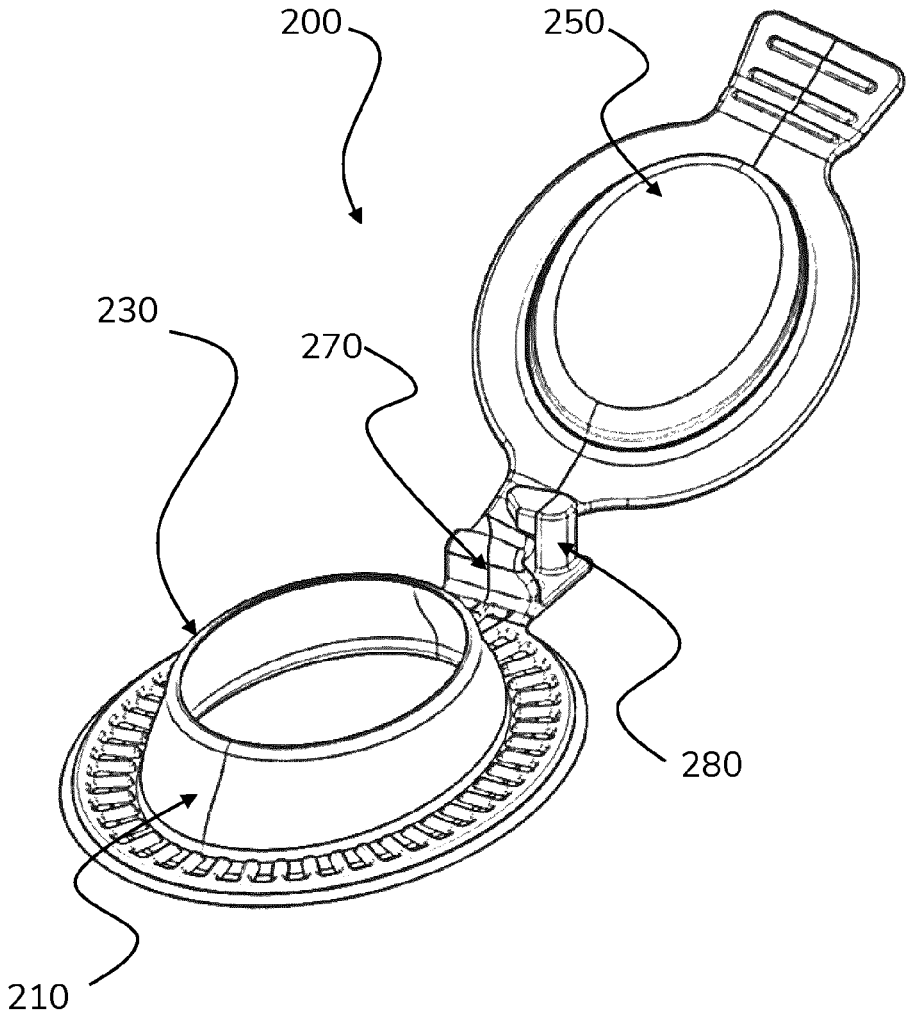

FIG. 7 shows a side view and FIG. 8 shows a perspective view of the exemplary drink spout 200 of FIGS. 5 and 6 when the lid portion 250 is in the second position allowing the user to conveniently drink from it. The lid portion 250 has been pivoted backwards and the connection portion 270 is engaged with the holder 280. The distal end 230 of the base portion is exposed for convenient drinking.

The flexure hinge in the connection portion may provide a second degree of freedom allowing the lid portion to be moved away from the pivoting plane defined by the first degree of freedom. The pivoting plane of the first angular degree of freedom may be defined by the trajectory in which attachment point between the connection portion and the lid portion moves when lid is moved according to the first degree of freedom. The pivoting plane may further comprise the centre point of the base portion. The pivoting plane may further comprise the attachment point between the connection portion and the base portion. The pivoting plane may further comprise the trajectory of the centre point of lid portion during movement of the lid portion along the first angular degree of freedom.

Considering this pivoting plane, the flexure hinge may provide a second degree of freedom which allows the lid portion to move along this second degree of freedom. To move along this second degree of freedom may include that the attachment point between the connection portion and the lid portion moves away from the pivotal plane. To move along this second degree of freedom may include that the centre point of the lid portion between the connection portion and the lid portion moves away from the pivotal plane. To move along this second degree of freedom may include that the lid portion is rotated around an axis that not parallel to the pivotal axis of the first angular degree of freedom.

The second degree of freedom may be secondary to the first degree of freedom. The preferred movement of the lid portion may be along the first degree of freedom. The equilibrium position for the lid portion may be along the first degree of freedom at a point between the first position and the second position. The equilibrium position may be on the pivotal plane of the first degree of freedom. The force required to move the lid portion along the second degree of freedom may be higher, at least for portion of this movement, than the force required to move the lid portion along the first degree of freedom. The connection portion may exert a restoration force on the lid portion which is directed such that the lid portion is forced to move back to the pivotal plane of the first degree of freedom.

The holder may be arranged such that the holder obstructs the movement of the lid portion along the first degree of freedom. The holder may be arranged such that the lid portion can only be moved into and out of the engaged position by moving the lid portion along the second degree of freedom. The holder may be arranged such that the lid portion can only be moved into and out of the engaged position by moving the lid portion around the holder by making use of the second degree of freedom.

The holder may have a fixed configuration in relation to the base portion. The holder may be flexible so that by exerting a force, the user can move the holder out of the way for the lid portion to pivot back into the first position along the first degree of freedom.

The connection portion may provide a restoration force directed such the lid portion is brought back to pivoting plane defined by the first degree of freedom. Such a restoration force would reduce the risk of the lid unintentionally moving out of the second position and thus potentially returning towards the first position and interfering with the user during drinking. The equilibrium position of the connection portion with respect to the second degree of freedom may be such that the connection always provides restoration force directed such that the lid portion and the connection portion are forced back into the pivoting plane of the first degree of freedom. When the lid portion is in the second position, this restoration force may contribute to keeping the lid portion in the second position and in engagement with the hook.

The drink spout of the container for pourable food according to the present invention may be adapted for drinking by sucking. Sucking requires that the lips of the consumer may be positioned around the distal end portion of the drink spout to form an air tight seal. The consumer sucks the pourable food from the drink spout by creating a depression in the mouth. The drink spout of the container for pourable food according to the present invention may be adapted for drinking by squeezing the container. Squeezing of the container requires that the material from which the body of the container is formed is sufficiently flexible or pliable such as a typical laminate packaging material comprising a paperboard layer. The squeezing of the container will reduce the internal volume of the body portion and cause the pourable food to be pushed out of the body portion and through the drink spout. The container of the present invention may further be adapted for drinking by a combination of sucking and squeezing the container. The drink spout of the container for pourable food according to the present invention may be adapted for drinking by pouring from the container. Pouring may be achieved by raising the body portion above the opening in the base portion of the drink spout. The pourable food would thus flow from the container through the drink spout under the action of the gravitational forces into the mouth of the consumer.

The conduit of the drink spout may be dimensioned to limit the through-flow of the pourable food to be comfortable for consumption by a human. The precise dimension may depend on the type and viscosity of the pourable food to be consumed and whether the food contains particulates such as fruit pieces.

The outer surface of the distal end portion of the base portion of the drink spout may have an oval shape in the horizontal cross-section. The oval shape corresponds to a convenient lip position while drinking. The longer axis of the oval cross section of the outer surface of the distal end portion may be aligned with the horizontal direction when the container is positioned in the intended drinking position. Having an oval or otherwise round circumference of the outer surface of the distal portion allows for convenient adaptation of the lips to the drink spout for comfortable drinking.

The proximal end portion of the base portion of the drink spout may also have an oval or otherwise round shape in the cross-section along the plane defined by the proximal end. Such design may support the convenient construction and manufacture of the drink spout. The conduit inside the drink spout may also have an oval or otherwise round inner cross-section. The longer axis of the oval-cross section of the proximal end portion may be aligned with the longer axis of the oval cross section of the outer surface of the distal end portion. The longer axis of the oval-cross section of the proximal end portion may be aligned with the longer axis of the oval cross section of the conduit inside the drink spout.

The attachment point between the connection portion and the base portion may be aligned with the longer axis of the oval-cross section of the proximal end portion. The longer axis of the oval-cross section of the proximal end portion may be aligned with the pivotal plane of the first degree of freedom of the lid portion.

The distal end portion of the base portion of the drink spout may have a frustoconical shape in the horizontal cross-section which is tapering towards the distal end. This shape allowed for a comfortable and effective seal between the lips of the consumer and the distal end portion during drinking. The distal end portion may have a smooth surface to allow for effective sealing with lips. The distal end portion may be free of threads since the lid portion cannot be screwed onto the distal end portion while being permanently attached to the base portion.

The distal end portion of the base portion of the drink spout may be dimensioned such that it can be comfortable sealed by the lips of the consumer while drinking. The distal end portion may have a dimension that is compatible with the form and size of the mouth of the intended user. The height of the distal end portion may be chosen such that the lips of the consumer can conveniently form a seal with it. The height of the distal end portion is the orthogonal distance of the opening in the distal end to the outer surface of body portion. The height of the distal end port may be at least 4 mm, preferably at least 5 mm, yet more preferably at least 6 mm, yet more preferable at least 8 mm, yet more preferable at least 10 mm.

The breakable sealing portion may be at least partially arranged below the distal end portion or at least the distal end of the base portion. If the breakable sealing portion is placed below, then the distal end portion is protected from contamination and soiling before the sealing portion is broken. After breaking this sealable portion, the consumer may thus drink from a more hygienically kept drink spout. The breakable sealing portion may be arranged fully below the distal end and fully encircle the distal end. The breakable sealing portion may be arranged at least partially below the distal end portion of the base portion. The breakable sealing portion may be arranged such that the distal end, preferably including at least a part of the distal end portion, is covered by the lid portion before the breakable sealing portion is broken.

The lid portion may comprise a flange portion which extends beyond the dimension of the distal end in the horizontal plane or in the plane defined by the distal end or in the plane defined by the proximal end. Contamination and soiling of the distal end portion of the base portion of the drink spout should be reduced as much as possible so that the consumer can drink from the container in a hygienic fashion. Such soiling and contamination can for example happen when the container is handled during placement in a shelf prior to its sale. Having a flange being comprised in the lid portion renders it less likely that the fingertips of the person handling the container touch the distal end portion of the drink spout's base portion which eventually will come into contact with the lips of the consumer.

The lid portion may further comprise a pull-tab for easy opening by the user. When pulling the pull-tab up, the user may tear open the breakable sealing portion thereby exposing the distal end of the base portion of the spout.

The proximal end of the base portion may be wider than the distal end and the base portion has a frustoconical shape between the proximal end and the distal end. This configuration allows for a good connection of the base portion to the outer surface of the body of the container. The good connection may facilitate the permanent attachment of the drink spout to the outer surface of the body portion The proximal end of the base portion may comprise a flange portion. The flange portion may increase the surface areas of the base portion which is attached to the body of the container and consequently the strength of the attachment. The flange portion may be positioned in the same plane that is defined by the proximal end of the base portion. The flange portion may be positioned along at least a portion or the entire circumference of the proximal end of the base portion. The extension of the flange parallel to the plane defined by the proximal end is substantially larger than the extension of the flange perpendicular to it so that the flange portion has an essentially planar configuration which is oriented parallel to plane defined by the proximal end and thus to the outer surface of the container to which the drink spout is attached. The surface size of the flange further reduces the chance that the lips of the consumer may come into contact with the packaging material instead of the drink spout. The packaging may be perceived by the consumer as less hygienic. The connection portion may be connected to the base portion through the flange portion.

FIG. 2 and FIG. 5 show an enlarged perspective views of exemplary embodiments of a drink spout suitable for use with the container for pourable food according to the present invention. The lid portion comprises a flange portion 260. The proximal end portion 235 of the base portion 210 comprises a flange portion 240.

The body of the container may be made from a laminate packaging material comprising a layer of paperboard and one or more layers of a polymeric material. The paperboard layer may provide structural stability to the package. The polymer layer may render the laminate packaging material sufficiently liquid impervious so that the container made from it may serve as container for pourable food. The team "paperboard" as used herein refers to any material that comprises cellulosic fibres or modified cellulosic fibres as a constituent. The content cellulosic fibres or modified cellulosic fibres may be high enough so that the fibre content becomes relevant for the material properties of the paperboard. Suitable paperboard layers are well known in the art. In principle, any packaging material or combination of packaging materials that is capable of holding pourable food when forming a container is suitable for the present invention.

The container may be made from a laminate packaging material comprising an oxygen barrier layer such as aluminium or a suitable polymer-based material.

The drink spout may be positioned over an opening in the body portion of the container. The opening may be created during the manufacturing of the container body before the drink spout is applied. The drink spout may be adhered over the opening on the outer surface of the body portion. The drink spout may be inserted through the opening from the inside and the adhered to the inner surface of the container body.

Alternatively, the drink spout may be positioned over a portion of the body of the container adapted for easy opening. The portion for easy opening may be created in the laminate packaging material by omitting at least one layer such as the paperboard layer. The portion for easy opening may be created by providing a weakening of the material around at least a portion of the circumference of the portion such as by perforating or partially cutting the material. The lid portion may be connected to the portion adapted for easy opening such that when the lid portion is pulled back for breaking the seal, the portion adapted for easy opening is also opened as a result of the same pulling motion.

The drink spout may further comprise an anchor portion which is positioned on the inner surface of the body portion opposite to the base portion and which is connected to the base portion. In this configuration the packaging material forming the body portion is sandwiched between the proximal end of the base portion and the anchor portion. When the anchor portion is present, it may not be necessary to attach the drink spout to the body of the container by any other means than sandwiching the packing material between the base portion and the anchor portion. The drink spout comprising lid, base, connection, and anchor portion may be manufactured in one piece. The drink spout may be injection moulded directly in one piece directly onto the packaging material. The material to form the drink spout may flow through the packaging material during the injection moulding process, either through a designated conduit which may be prepared particularly for that purpose or may migrate through the material under the action of the pressure exerted onto the material under the injection process. Alternatively, the anchor portion may be manufactured separately from the other portions of the drink spout. The anchor portion may then be connected to base the portion by a click-and-connection which pierces the packaging material during the application process.

Figure 9:
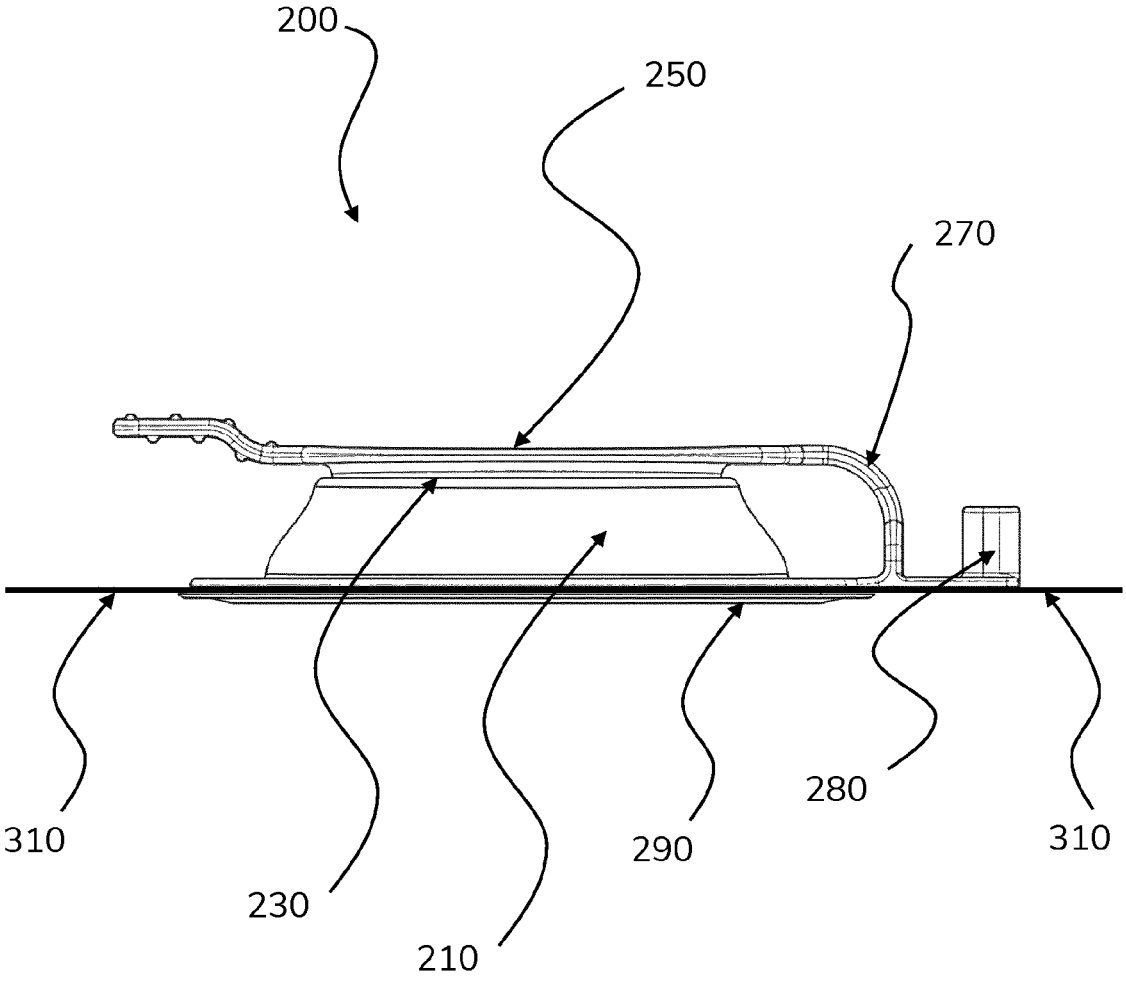
FIG. 9 shows a side view of an exemplary drink spout of the present invention.

FIG. 9 shows a side view of an exemplary drink spout of the present invention. The drink spout (200) further comprises an anchor portion (290) which positioned on the inner surface of the body portion (310) opposite to the base portion (210) and which is connected to the base portion.

It is another aspect of the present invention to provide a drink spout suitable for use with a container for pourable food according to the present invention. Such a drink spout may be manufactured separate from the filling and sealing of the body portion of the container. The drink spout may be applied before or after the filling and sealing operation. The drink spout may be applied from the inside through a hole in the material forming the body portion. The drink spout is then permanently attached to the inner surface of the body portion such as by attaching the flange of the base portion to the inner surface. In this configuration, the drink spout forms part of the initial sealing of the body portion. Alternatively, the drink spout may be permanently attached to the outer surface of the body portion. This operation may take place before or after the filling and sealing of the body portion. The drink spout may be placed over a pre-existing opening in the body portion in which case the drink spout contributes to the initial sealing of the body portion. The drink spout may also be applied of a portion of the body portion that is adapted for easy opening such as a pre-laminated hole.

One suitable method for manufacturing the container of the present invention is to produce the drink spout with all its components by injection moulding or more specifically micro injection moulding. The drink spout is the attached to the packaging material before or after the container is filled with the pourable food and subsequently sealed. A suitable material for injection moulding the drink spout is polyethylene.

The drink spout may comprise at least 80 weight %, preferably at least 90 weight-%, or preferably 95 weight-%, yet more preferably 98 weight-%, of one type of polymer such as polyolefins (for example polyethylene or polypropylene), polyesters (for example PET or PEF). The drink spout may be made from polymers obtain from renewable sources instead of fossil fuel-based sources. The drink spout may be made from compostable, industrially compostable, biodegradable, or industrially biodegradable polymers. The drink spout may be from fibre-based materials (such as fibre reinforced polymer composites).

The present invention has been described above with reference to specific examples. However, other examples than the above described are equally possible within the scope of the invention. The different features and steps of the invention may be combined in other combinations than those described. The scope of the invention is only limited by the appended patent claims.

More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

The invention claimed is:

1. A container for pourable food, the container comprising:

an initially sealed body portion for holding the pourable food;

a drink spout configured for drinking from the container;

the drink spout comprises a base portion having a proximal end and a distal end;

the proximal end of the base portion of the drink spout being permanently attached to the body portion;

the proximal end of the base portion of the drink spout including an opening adapted for receiving pourable food from the body portion of the container;

the distal end of the base portion of the drink spout including an opening adapted for drinking the pourable food from the container;

the opening at the proximal end of the base portion of the drink spout and the opening at the distal end of the base portion of the drink spout being connected by a conduit for pourable food;

the drink spout comprising a lid portion;

the lid portion being initially attached to the base portion so that the lid portion seals the opening at the distal end by a breakable sealing portion, the sealing portion being configured to be broken by the user so that the opening of the base portion becomes accessible;

the drink spout comprises a connection portion having one end fixed to the base portion of the drink spout and an opposite end fixed to the lid portion to permanently attach the lid portion to the base portion, the connection portion being a flexure hinge providing a first angular degree of freedom allowing the lid portion to pivot away from the base portion after the breakable sealing portion has been broken; and the drink spout comprising a holder that is configured to engage a portion of the lid portion or the connection portion to hold the lid portion in a drinking position and allow the user to drink the pourable food from the container, the holder being fixed to the base portion and being spaced from the connection portion when the lid portion seals the opening at the distal end by the breakable sealing portion.

2. A container for pourable food according to claim 1, wherein the lid portion is pivotable around an axis that is parallel to the surface defined by the proximal end and that is a tangent to the base portion at the point where the connection portion is attached to the base portion.

3. A container for pourable food according to claim 1, wherein the lid portion is pivotable between a first position for protecting the base portion and a second position that is the drinking position.

4. A container for pourable food according to claim 1, wherein the flexure hinge provides a second degree of freedom allowing the lid portion to be moved away from a pivoting plane defined by the first angular degree of freedom and wherein the holder is arranged such that the lid portion can only be moved into the drinking position in which the holder engages the portion of the lid portion or the connection portion by moving the lid portion along the second degree of freedom.

5. A container for pourable food according to claim 1, wherein the connection portion provides a restoration force directed such the lid portion is brought back to a pivoting plane defined by the first angular degree of freedom.

6. A container for pourable food according to claim 1, wherein the outer surface of a distal end portion of the base portion of the drink spout has an oval shape in a cross-section along a plane defined by the proximal end.

7. A container for pourable food according to claim 1, wherein a proximal end portion of the base portion of the drink spout has an oval shape in the horizontal cross-section.

8. A container for pourable food according to claim 1, wherein a distal end portion of the base portion of the drink spout has a frustoconical shape in the horizontal cross-section which is tapering towards the distal end.

9. A container for pourable food according to claim 1, wherein the breakable sealing portion is arranged below the distal end of the base portion.

10. A container for pourable food according to claim 1, wherein the lid portion comprises a flange portion which extends beyond a dimension of the distal end in a plane defined by the distal end.

11. A container for pourable food according to claim 1, wherein the proximal end of the base portion is wider than the distal end and the base portion has a frustoconical shape between the proximal end and the distal end.

12. A container for pourable food according to claim 1, wherein the container is made from a laminate packaging material comprising a layer of paperboard.

13. A container for pourable food according to claim 1, wherein the container is made from a laminate packaging material comprising an oxygen barrier layer.

14. A container for pourable food according to claim 1 wherein the drink spout is positioned over an opening in the body of the container.

15. A container for pourable food according to claim 1, wherein the drink spout is positioned over a portion of the body of the container adapted for easy opening.

16. A container for pourable food according to claim 1, wherein the drink spout further comprises an anchor portion which is positioned on the inner surface of the body portion opposite to the base portion and which is connected to the base portion.

17. A container for pourable food, the container comprising:

an initially sealed body portion for holding the pourable food;

a drink spout configured for drinking from the container;

the drink spout comprising a base portion that includes a proximal end and a distal end, the base portion also having an outer peripheral surface extending between the proximal end of the base portion and the distal end of the base portion, the base portion of the drink spout also including a flange portion at the proximal end of the base portion, the flange portion projecting outwardly away from the outer peripheral surface of the base portion, the flange portion having one surface facing towards the initially sealed body portion and an other surface facing away from the initially sealed body portion;

the one surface of the flange portion being permanently attached to the body portion;

the proximal end of the base portion including an opening adapted for receiving pourable food from the body portion of the container;

the distal end of the base portion including an opening adapted for drinking the pourable food from the container;

the opening at the proximal end of the base portion and the opening at the distal end of the base portion being connected by a conduit for pourable food;

the drink spout comprising a lid portion;

the lid portion being initially attached to the base portion so that the lid portion seals the opening at the distal end by a breakable sealing portion, the sealing portion being configured to be broken by the user so that the opening of the base portion becomes accessible;

the drink spout comprising a connection portion that includes one end fixed to the lid portion and an opposite end fixed to the base portion to permanently attach the lid portion to the base portion; and the drink spout including a holder that is configured to engage a portion of the lid portion or the connection portion to hold the lid portion in a drinking position and allow the user to drink the pourable food from the drink spout of the container, the holder being fixed to the flange portion and projecting away from the other surface of the flange portion, the holder being arranged relative to the connection portion so that as the lid portion is moved toward the drinking position, the connection portion and the lid portion move relative to the fixed holder to cause the portion of the lid portion or the connection portion to be engaged by the holder.

18. A container for pourable food according to claim 17, wherein the holder is a hook.

19. A container for pourable food, the container comprising:

an initially sealed body portion for holding the pourable food;

a drink spout configured for drinking from the container;

the drink spout comprises a base portion having a proximal end and a distal end, the base portion also including an outer peripheral surface;

the proximal end of the spout being permanently attached to the body portion;

the proximal end of the spout including an opening adapted for receiving pourable food from the body portion of the container;

the distal end of the spout includes an opening adapted for drinking the pourable food from the container;

the opening at the proximal end of the spout and the opening at the distal end of the spout being connected by a conduit for pourable food;

the drink spout comprising a lid portion;

the lid portion being initially attached to the base portion so that the lid portion seals the opening at the distal end by a breakable sealing portion, the sealing portion being configured to be broken by the user so that the opening of the base portion becomes accessible;

the drink spout comprising a connection portion permanently attaching the lid portion to the base portion, the connection portion being a flexure hinge providing a first angular degree of freedom allowing the lid portion to pivot away from the base portion after the breakable sealing portion has been broken;

the connection portion being configured so that after the breakable sealing portion has been broken, the lid portion is pivotable: i) away from the base portion to a drinking position to allow lips of the user to be positioned around a distal end portion of the drink spout so that the user can drink the pourable food from the container; and ii) from the drinking position to a position in sealing contact with the distal end of the base portion when the user is not drinking from the container; and the drink spout comprising a holder that is configured to engage a portion of the lid portion or the connection portion when the lid portion is pivoted to the drinking position to hold the lid portion in the drinking position and allow the user to drink the pourable food from the container, the portion of the lid portion or the connection portion being moved out of engagement with holder when the lid portion is pivoted to the position in sealing contact with the distal end of the base portion, the holder being spaced from the outer peripheral surface of the base portion.

20. A container for pourable food according to claim 19, wherein the base portion includes a flange portion at the proximal end of the base portion, the flange portion having one surface facing towards the initially sealed body portion and an other surface facing away from the initially sealed body portion, the holder including an upstanding part fixed to the other surface of the flange portion and projecting away from the other surface of the flange portion, the holder also including an other part that is angled relative to the upstanding part and that overlies the other surface of the flange portion.

21. A container for pourable food according to claim 20, wherein the connection portion includes one end fixed to the lid portion an opposite end fixed to the base portion at a fixation region, the fixation region being spaced from the holder.

* * * * *